US007878247B2

(12) United States Patent
Misselbrook et al.

(10) Patent No.: US 7,878,247 B2
(45) Date of Patent: Feb. 1, 2011

(54) METHODS FOR CLEANING OUT HORIZONTAL WELLBORES USING COILED TUBING

(75) Inventors: John Gordon Misselbrook, Calgary (CA); William Arthur Hutton Aitken, Calgary (CA); Jeff Li, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 99 days.

(21) Appl. No.: 12/350,852

(22) Filed: Jan. 8, 2009

(65) Prior Publication Data

US 2010/0170676 A1 Jul. 8, 2010

(51) Int. Cl.
*E21B 37/00* (2006.01)
*E21B 43/25* (2006.01)
*E21B 43/26* (2006.01)

(52) U.S. Cl. ..... 166/298; 166/308.1; 166/311; 166/312; 134/23

(58) Field of Classification Search ..... None
See application file for complete search history.

(56) References Cited

U.S. PATENT DOCUMENTS

| | | | | |
|---|---|---|---|---|
| 4,671,359 | A * | 6/1987 | Renfro | 166/312 |
| 4,744,420 | A * | 5/1988 | Patterson et al. | 166/312 |
| 5,086,842 | A * | 2/1992 | Cholet | 166/312 |
| 5,158,140 | A * | 10/1992 | Ferry | 166/312 |
| 5,462,118 | A * | 10/1995 | Jennings et al. | 166/312 |
| 5,765,642 | A | 6/1998 | Surjaatmadja | 166/297 |
| 5,865,249 | A * | 2/1999 | Gipson et al. | 166/312 |
| 6,073,696 | A * | 6/2000 | Ellis | 166/312 |
| 6,394,184 | B2 | 5/2002 | Tolman et al. | 166/281 |
| 6,607,607 | B2 | 8/2003 | Walker et al. | 134/18 |
| 6,923,871 | B2 | 8/2005 | Walker et al. | 134/24 |
| 6,982,008 | B2 | 1/2006 | Walker et al. | 134/24 |
| 7,090,018 | B2 * | 8/2006 | Livingstone | 166/312 |
| 5,765,642 | C1 | 9/2006 | Surjaatmadja | 166/297 |
| 7,225,869 | B2 | 6/2007 | Willett et al. | 166/280.1 |
| 7,377,283 | B2 | 5/2008 | Walker et al. | 134/22.1 |
| 2004/0104030 | A1 * | 6/2004 | Livingstone | 166/312 |

(Continued)

FOREIGN PATENT DOCUMENTS

| | | |
|---|---|---|
| CA | 2344754 | 10/2001 |

(Continued)

OTHER PUBLICATIONS

A.R. Crabtree, J. Li, B. Luft, BJ Services Company, "*Reverse Circulation Cleanouts with Coiled Tubing*," Offshore Mediterranean Conference and Exhibition, Ravenna, Italy, Mar. 28-30, 2007.

(Continued)

*Primary Examiner*—George Suchfield
(74) *Attorney, Agent, or Firm*—Zarian Midgley & Johnson PLLC

(57) ABSTRACT

Methods for cleaning out horizontal wellbores using coiled tubing are provided for use during downhole operations. A coiled tubing having a bottom hole assembly is deployed into a horizontal wellbore. Fluid is circulated down the annulus of the wellbore and up the bottom hole assembly while the bottom hole assembly is moved upward at a selected rate and distance. This method may be used to remove downhole solids, such as formation sands and proppant.

28 Claims, 14 Drawing Sheets

U.S. PATENT DOCUMENTS

2008/0217019 A1 9/2008 Walker et al. ..... 166/312

FOREIGN PATENT DOCUMENTS

GB 2361729 A 10/2001
NO 321056 B1 3/2006

OTHER PUBLICATIONS

P.S. Kumar, SPE, B. Al-Amri, et al "*Coiled-Tubing Reverse Circulation—An Efficient Method of Cleaning Horizontal Wells in a Mature, Pressure-Depleted Field*," SPE 92804, 2005 Asia Pacific Oil & Gas Conference and Exhibition, Jakarta, Indonesia, Apr. 5-7, 2005.

Li, J. Walker, S. and Aitken, B., BJ Services Company, "*How to Efficiently Remove Sand From Deviated Wellbores With a Solids Transport Simulator and a Coiled Tubing Cleanout Tool*," SPE 77527, SPE Annual Technical Conference and Exhibition, San Antonio, Sep. 29-Oct. 2, 2002.

Li J. and B. Luft, BJ Services Company, "*Fills Cleanout with Coiled Tubing in the Reverse Circulation Mode*,"SPE 102661, IADC/SPE Asia Pacific Drilling Technology Conference and Exhibition, Bankok, Thailand, Nov. 13-15, 2006.

Li J., J. G. Misselbrook and J. Seal, BJ Services Company, "*Sand Cleanout with Coiled Tubing: Choice of Process, Tools or Fluids?*" SPE 113267, 2008 SPE/EAGE Annual Conference and Exhibition, Rome, Italy, Jun. 9-12, 2008.

Michel, Charlie, Stephens, Rodney et al "*Reverse Circulation with Coiled Tubing—Results of 1600+ Jobs*," SPE 89505, SPE/ICoTA Coiled Tubing Conference and Exhibition, Houston, Texas, Mar. 23-24, 2004.

M. Sach, J. Li, BJ Services Company "Repeatedly Increased Efficiency and Success Rate from a New Solids-Cleanout Process Using Coiled Tubing: A Review of Recent achievements from More than 100 Operations"; 2007 SPE/ICoTA Coiled Tubing and Well Intervention Conference and Exhibition, The Woodlands, Texas, Mar. 20-21, 2007.

Circa TM Software, BJ Services Company, "*Total Job Design in a Single Software Package*", Coiled Tubing Products and Services, Mar. 30, 2004, 2 pgs.

* cited by examiner

AT THE INTERFACE WE HAVE HIGH SHEAR DUE TO THE LOW VELOCITY OF THE BED SURFACE COMPARED WITH THE FLUID/SLURRY TRAVELING OVER IT.

Mass Balance for the stationary hole cleaning prediction

Circulation time ratio versus removed solids volume ratio based on the lump model for the stationary hole cleaning in a horizontal wellbore Stationary and POOH reverse circulation hole cleaning time in horizontal wellbore Maximum RIH (Run-In-Hole) speed of reverse circulation in horizontal wellbore Maximum POOH speed of reversing circulation in horizontal wellbore Hole cleaning efficiency during POOH with the reverse circulation in horizontal wellbore Complete hole cleaning during RIH with reverse circulation in 4.5" casing, 2000ft horizontal section

METHODS FOR CLEANING OUT HORIZONTAL WELLBORES USING COILED TUBING

BACKGROUND OF THE INVENTION

1. Field of the Invention

The present invention relates generally to wellbore cleanout techniques and, more particularly, to cleaning out horizontal wellbores using coiled tubing.

2. Description of the Related Art

In typical annular coiled tubing fracturing techniques, operators run a bottom hole assembly ("BHA") in the well with coiled tubing, perforate the casing, pull the bottom hole assembly past the build section into the vertical section of the well or even out of the well entirely, and then begin pumping fracturing fluid. A sand plug is then set as the final stage of the fracture pumping operation, the BHA is run back in hole to a desired location above the previous interval and another interval is perforated. The BHA is then pulled back into the vertical section or out of the well, and fracturing commences again. Accordingly, there are multiple trips in and out of the well. In some instances, the use of mechanical bridge plugs is preferred over sand plugs; when this is the case, the BHA must be fully removed from the well after each perforating operation, in order to pump the fracturing fluid and, at the same time, fit a new plug on the bottom of the perforating BHA.

It is economically desirable to perforate, fracture and isolate each interval quickly, so that all intervals can be treated in the shortest time possible, preferably within a day. However, the nature of horizontal wells creates beds of solids, such as sand or proppant, which settle on the bottom side of the horizontal section, introducing additional complexities into the reliable execution of the fracturing process. In a horizontal well, gravity causes the coiled tubing to sit on the lower side of the well, creating an eccentric flow channel along the annulus. As fluid flows down the annulus, a region of high shear is created around the coiled tubing, which causes proppants in the fracturing fluid to settle on the low side of the hole, creating a proppant bed, for example. Given that a horizontal section could spans thousands of feet, several thousand pounds of proppant can be deposited along the bottom of the horizontal section.

The proppant bed must be removed before the next perforated interval is fractured. If the proppant bed is not cleaned, the pad for the next fracture can entrain this proppant, thereby creating a high potential for premature screen out.

Generally, there are three methods of removing solids from wells. The first method, called "stationary circulating," involves circulating clean fluid down the coiled tubing and blowing the proppant up the annulus until all the proppant has been transported out of the well while the coiled tubing is stationary. The second method, called a "wiper trip," involves circulating down the coil and washing the proppant back up the annulus while pulling the BHA out of the hole. The third method, called reversing, involves circulating down the annulus and washing proppant up the coil while the BHA is running in hole.

There are disadvantages to the traditional cleaning methods. In a typical 10,000 ft horizontal well, using 2" coiled tubing it would take about 6 hours to remove the proppant using the circulating method. In the same well using the wiper trip, the clean out would take about 3 hours. Moreover, since wiper tripping requires pulling the BHA practically all the way to surface, operators then have to run back into the hole in order to perforate the next interval and continue fracturing.

Lastly, using the reversing method, a clean out could take somewhere in the range of 1½ hours which, while faster than the other two methods, is still time consuming and negatively impacts overall process efficiency.

In view of these disadvantages, there is a need in the art for an improved method for cleaning out a horizontal well which substantially reduces the cleanout time, allowing more intervals to be fractured in a day.

SUMMARY OF THE INVENTION

Various embodiments of the present invention provide methods for cleaning out horizontal wellbores using coiled tubing. In an exemplary embodiment of the present invention, coiled tubing having a BHA configured to allow reverse flow is inserted into a horizontal wellbore. Fluid is then circulated down the annulus of the wellbore and back up the BHA and coiled tubing, while the BHA is being moved uphole. Accordingly, debris above the bottom end of the coiled tubing, such as a proppant/sand bed, may be cleaned out of the wellbore at an efficient rate.

The cleanout technique of the present invention may be utilized in a variety of methods. For example, an exemplary method may further comprise at least perforating an interval of the horizontal wellbore before circulating fluid down the annulus. Another exemplary embodiment may include fracturing an interval of the horizontal wellbore before circulating down the annulus. This exemplary method may further comprise removing or at least substantially removing a proppant bed from the horizontal wellbore. This exemplary method may be conducted without removing the BHA from the wellbore or, in the alternative, the horizontal section of the wellbore.

An alternative exemplary method may also comprise the steps of deploying coiled tubing into the horizontal wellbore, the coiled tubing comprising a BHA; at least perforating a first interval of the horizontal wellbore; circulating fluid down an annulus of the horizontal wellbore and back up the coiled tubing while moving the BHA uphole at a selected rate and distance; and at least perforating a second interval of the horizontal wellbore. This exemplary method may further comprise conducting the perforating and circulation steps without removing the BHA from the wellbore or, in the alternative, the horizontal section of the wellbore. This exemplary method may further comprise removing solids from the horizontal wellbore.

Yet another alternative exemplary method may comprise the steps of at least perforating an interval of the horizontal wellbore; and circulating a proppant bed of the horizontal wellbore up the coiled tubing while moving the coiled tubing uphole. In this exemplary method, the coiled tubing may comprise a BHA which remains below the build section of the horizontal wellbore. In the alternative, the BHA remains in the horizontal wellbore during circulation. In the alternative, the step of circulating the proppant bed up the coiled tubing is achieved by circulating fluid down an annulus of the horizontal wellbore and back up a BHA forming part of the coiled tubing, the annulus being located between the coiled tubing and casing. This exemplary method may further comprise the step of at least perforating a second interval of the horizontal wellbore without removing the coiled tubing from the horizontal wellbore or, in the alternative, the horizontal section of the horizontal wellbore.

Yet another alternative exemplary method may provide the steps of reverse circulating a portion of solids out of the wellbore while moving uphole, and then running back into the hole while reverse circulating to remove the remainder of the solids.

The foregoing summary is not intended to summarize each potential embodiment or every aspect of the subject matter of the present disclosure. Other objects and features of the invention will become apparent from the following description with reference to the drawings.

Figure 1A:
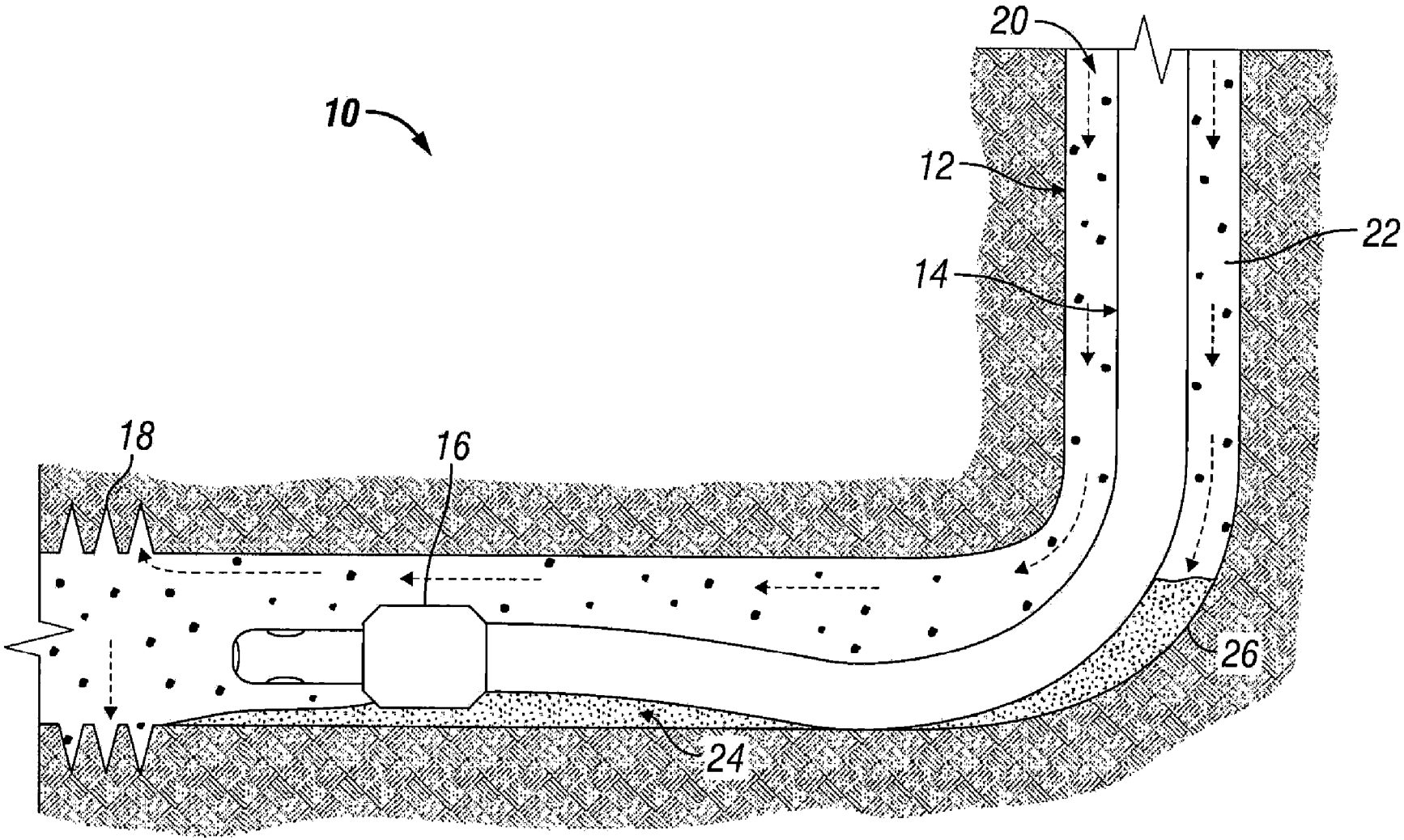
FIG. 1A illustrates step 1 according to an exemplary method of the present invention.

Wile the invention is susceptible to various modifications and alternative forms, specific embodiments and methods have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DETAILED DESCRIPTION OF ILLUSTRATIVE EMBODIMENTS

Illustrative embodiments of the invention are described below as they might be employed in methods for cleaning out horizontal wellbores using coiled tubing. In the interest of clarity, not all features of an actual implementation are described in this specification. It will of course be appreciated that in the development of any such method, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1A, a horizontal wellbore 10 is illustrated according to an exemplary embodiment of the present invention. For purposes of the present invention, the term "horizontal wellbore" refers to horizontal or highly deviated wells as understood in the art, such as, for example, those wells where the interval to be perforated is between 70-110 degrees from vertical. The term "horizontal section" of the horizontal wellbore refers to the section of horizontal wellbore 10 below the build section.

Figure 1B:
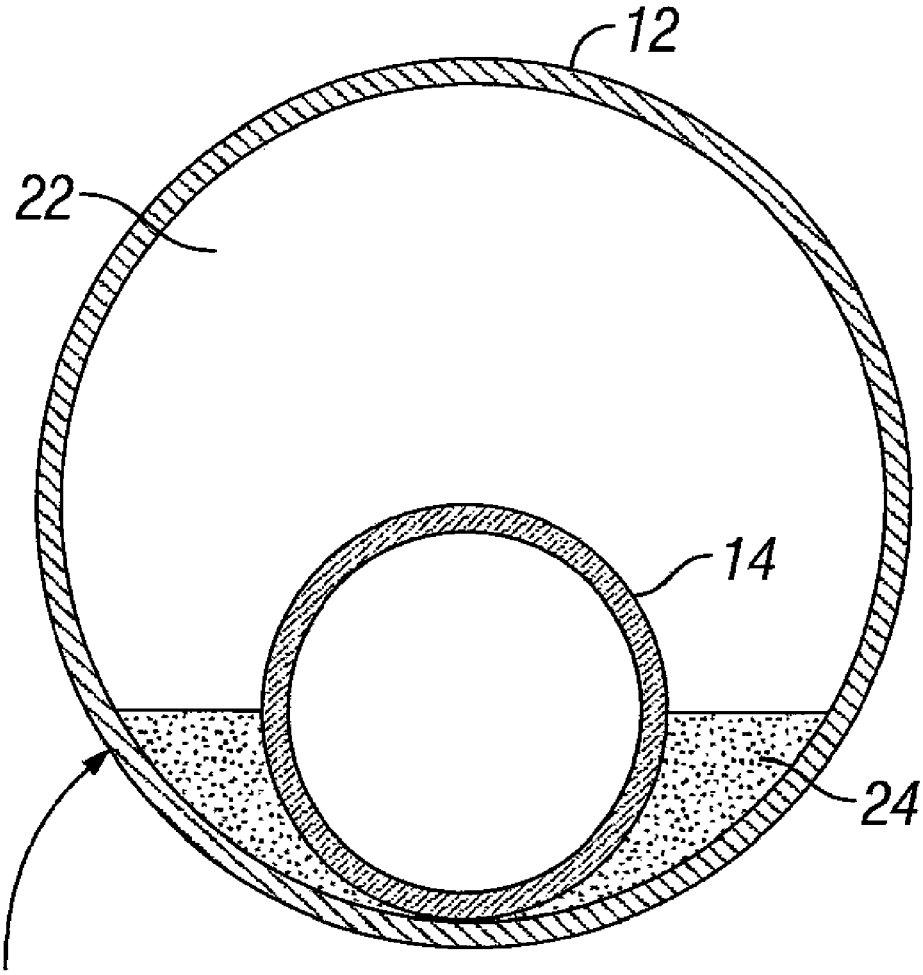
FIG. 1B is a cross-sectional view of the casing/coiled tubing annulus of an exemplary embodiment of the present invention.

Horizontal wellbore 10 includes a casing 12 having a coiled tubing 14 extending downhole. Due to gravitational forces, coiled tubing 14 is located on the low side of casing 12, as shown in FIG. 1B. A BHA 16 is connected to the end of coiled tubing 14 via a connector as known in the art, such as, for example, a "grapple" connector. Although BHA 16 may take a variety of forms as known in the art, in a preferred embodiment of the present invention, BHA 16 comprises a sand jet perforating tool equipped for reverse circulation. However, those ordinarily skilled in the art having the benefit of this disclosure realize there are a variety of perforating tools which could be employed. Perforations 18 penetrating the casing 14 are selectively positioned downhole for the production of oil and gas hydrocarbons as understood in the art. Those of ordinary skill in the art having the benefit of this disclosure also realize that horizontal wellbore 10 may be designed and constructed in a variety of ways.

Further referring to FIG. 1A, step one in an exemplary method of the present invention will now be described. As illustrated in FIG. 1A, the sand jetting tool of BHA 16 has been utilized to create perforations 18 and subsequently moved partway uphole. Thereafter, while BHA 16 is still in the horizontal section of wellbore 10, fracturing slurry 20 is pumped down annulus 22 using pumping techniques known in the art. As slurry 20 is pumped, a proppant bed 24 begins to form on the low side of casing 12 due to reasons which will be discussed below. However, in the alternative, proppant bed 24 may begin to form during the perforating of interval 18 if sand perforating methods are utilized.

Proppant bed 24 is created due to the nature of horizontal wellbore 10. In a horizontal well, the coil sits on the lower side of the well due to gravity, creating an eccentric flow channel along annulus 22, as illustrated in FIG. 1B. This eccentric flow channel creates an area of high shear between coiled tubing 14 on the lower side of casing 12 and the fracturing slurry 20. As fracturing slurry 20 travels down the annulus, the high shear area causes the proppant in slurry 20 to begin settling on the low side of the casing 12, creating proppant bed 24. Typically, proppant bed 24 tends to form behind BHA 16 and extends up to build section 26, which could span thousands of feet.

Figure 2:
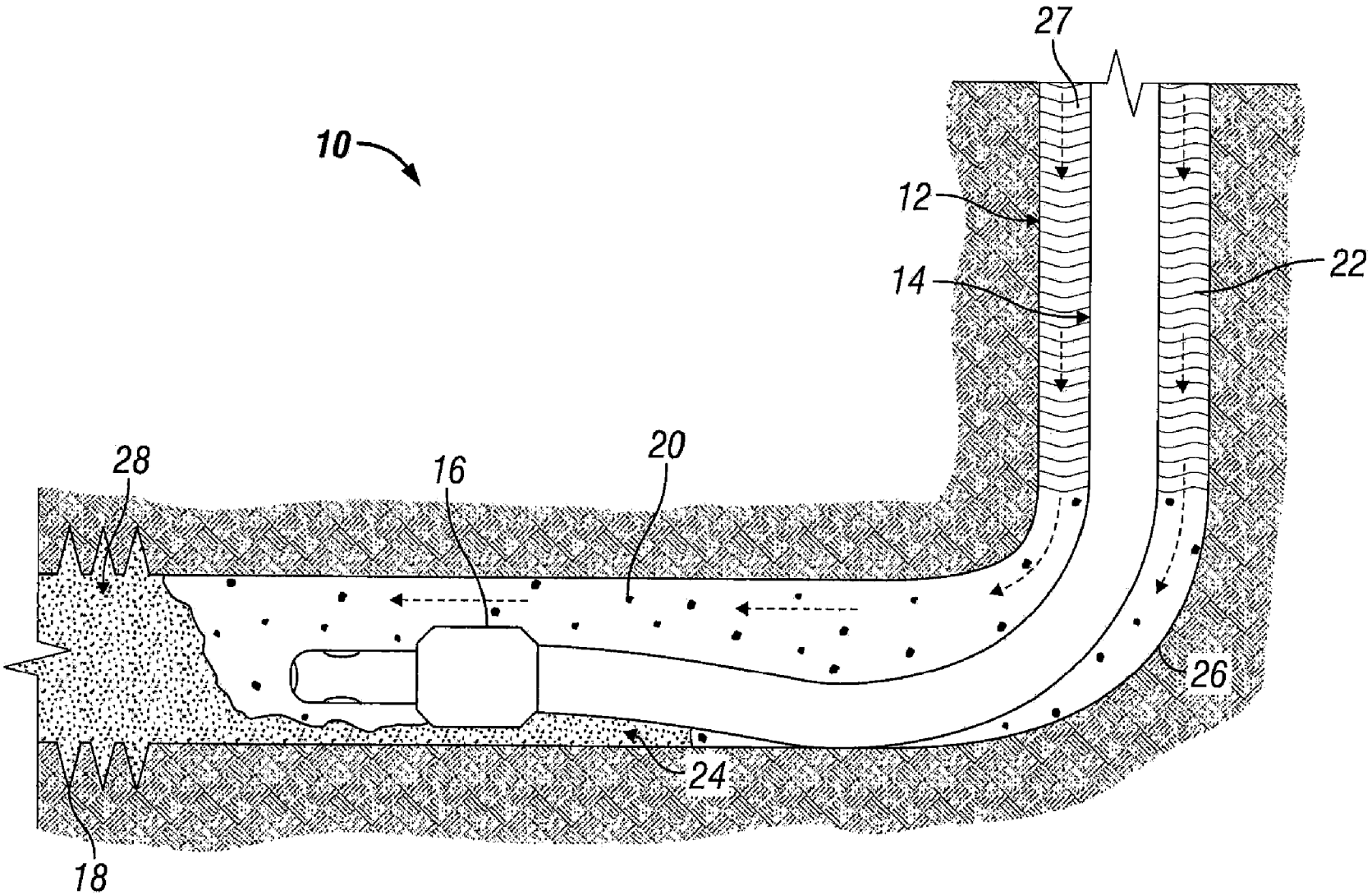
FIG. 2 illustrates step 2 according to an exemplary method of the present invention.

Referring to FIG. 2, step 2 in an exemplary method of the present invention will now be described. As previously discussed, while coiled tubing 14 and BHA 16 are still in the horizontal section of the well, fracturing slurry 20 is pumped downhole. Added to the final stage of the fracturing slurry is a small volume of fluid with elevated sand concentrations that will create sand plug 28, as known in the art. Clean displacement fluid 27 is then pumped behind slurry 20 in order to displace the fracturing slurry into the perforations. In the most preferred embodiment, displacement fluid 27 is pumped at the same rate as fracturing slurry 20. Also, as shown, the pumping of displacement fluid 27 at least partially erodes proppant bed 24, however, the bed is still present along a section of the horizontal wellbore. Although sand plug 28 is utilized in this exemplary embodiment, those ordinarily skilled in the art having the benefit of this disclosure realize there are a variety of ways to isolate perforations 18.

Figure 3A:
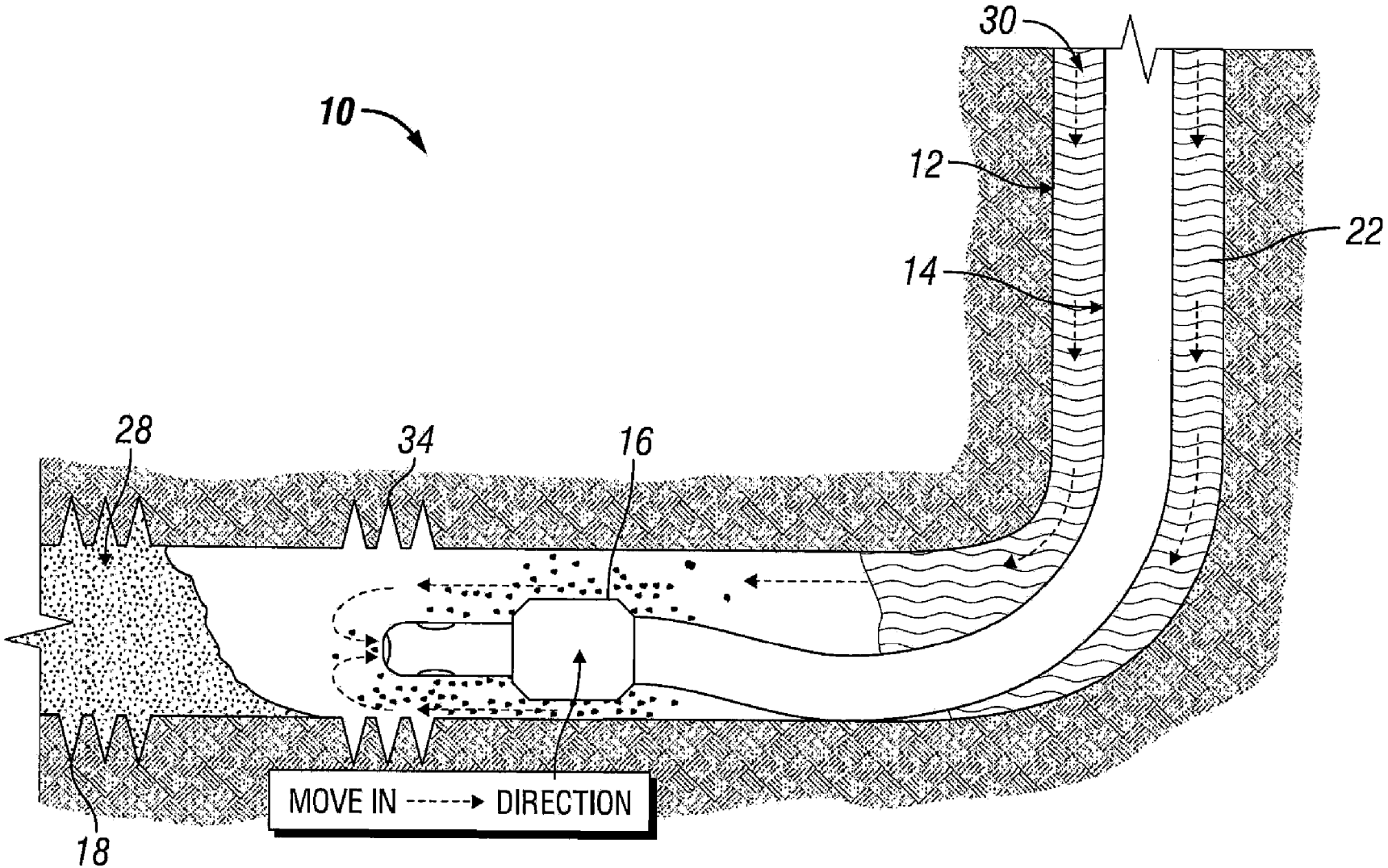
FIG. 3A illustrates step 3 according to an exemplary method of the present invention.

Referring to FIG. 3A, step 3 in an exemplary method of the present invention will now be described. Perforations 34 are now created using BHA 16. Now that sand plug 28 and perforations 34 have been created, further fracturing may begin. However, in order to avoid premature screen out issues for the perforated interval 34 during fracturing, proppant bed 24 and other residual solids in casing 12 must be removed. In order to achieve this, the present invention includes moving the BHA 16 uphole at a selected rate and distance along the horizontal section of wellbore 10, while moving the residual solids (such as, for example, proppant or formation sands) and proppant bed 24 downhole using fluids circulated down annulus 22. Those ordinarily skilled in the art having the benefit of this disclosure realize there are a variety of software programs and techniques available to calculate such fluid flow rates, pull out of hole speeds and distances, such as, for example, the Circa™ software program, developed by BJ Services Company of Houston, Tex., or some other comparably powered software program.

In the most preferred embodiment, the selected distance in which BHA 16 is moved upward, is a distance whereby the BHA 16 not only remains in the horizontal section of wellbore 10 ("horizontal section" meaning the section of horizontal wellbore 10 below build section 26), but also does not pull significantly past the next interval to be perforated. However, in the alternative, BHA 16 may be pulled above build section 26 to facilitate removal of solids in build section 26.

The operation of the clean out process will now be described. While BHA 16 is being moved upward, clean up fluid 30 is pumped down annulus 22, thereby circulating residual solids and proppant bed 24 downhole toward sand plug 28. Because the well is plugged with sand plug 28, the cleanout fluid 30 being pumped down annulus 22 has no where to go other than flowing through BHA 16, up along coiled tubing 14 and back to the surface. As cleanout fluid 30 turns the corner and enters BHA 16, the flow geometry arising from the abrupt change in direction of the fluid 30 entrains additional solids so that the net concentration of solids entering BHA 16 is greater than the concentration of solids being transported downwards by the annular low alone. The act of moving the coiled tubing uphole serves to effectively increase the solid concentration entrained in the cleanout fluid at the entrance to the BHA 16, which correspondingly reduces the cleanout time.

Cleanout fluid 30 is pumped until proppant bed 24 has been at least substantially removed. In an exemplary embodiment, cleanout fluid 30 is displaced by the pad fluid for the next frac treatment or may be the pad fluid for the next fracture treatment. However, those ordinarily skilled in the art realized there are a variety of fluids which may be utilized for this purpose. After proppant bed 24 is removed, only cleanout fluid 30 is present in annulus 22. As such, the next interval can be fractured without the danger of premature screenout.

This process of reversing, while moving upward, cuts the clean up time, using conventional methods, typically by more than 50% because the residual solids and proppant bed 24 are forced up coil tubing 14 at least at twice the rate of a stationary reverse cleanout. During numerical simulation of the present invention, for example, the clean up time was approximately ½ hour for a 3000 foot horizontal section. Analysis of proppant bed erosion hydraulics in an eccentric annulus indicate that, by reducing the cleanout time as disclosed herein, approximately 60% or more fracturing stages can be pumped per day than are currently being pumped using conventional methods.

Figure 3B:
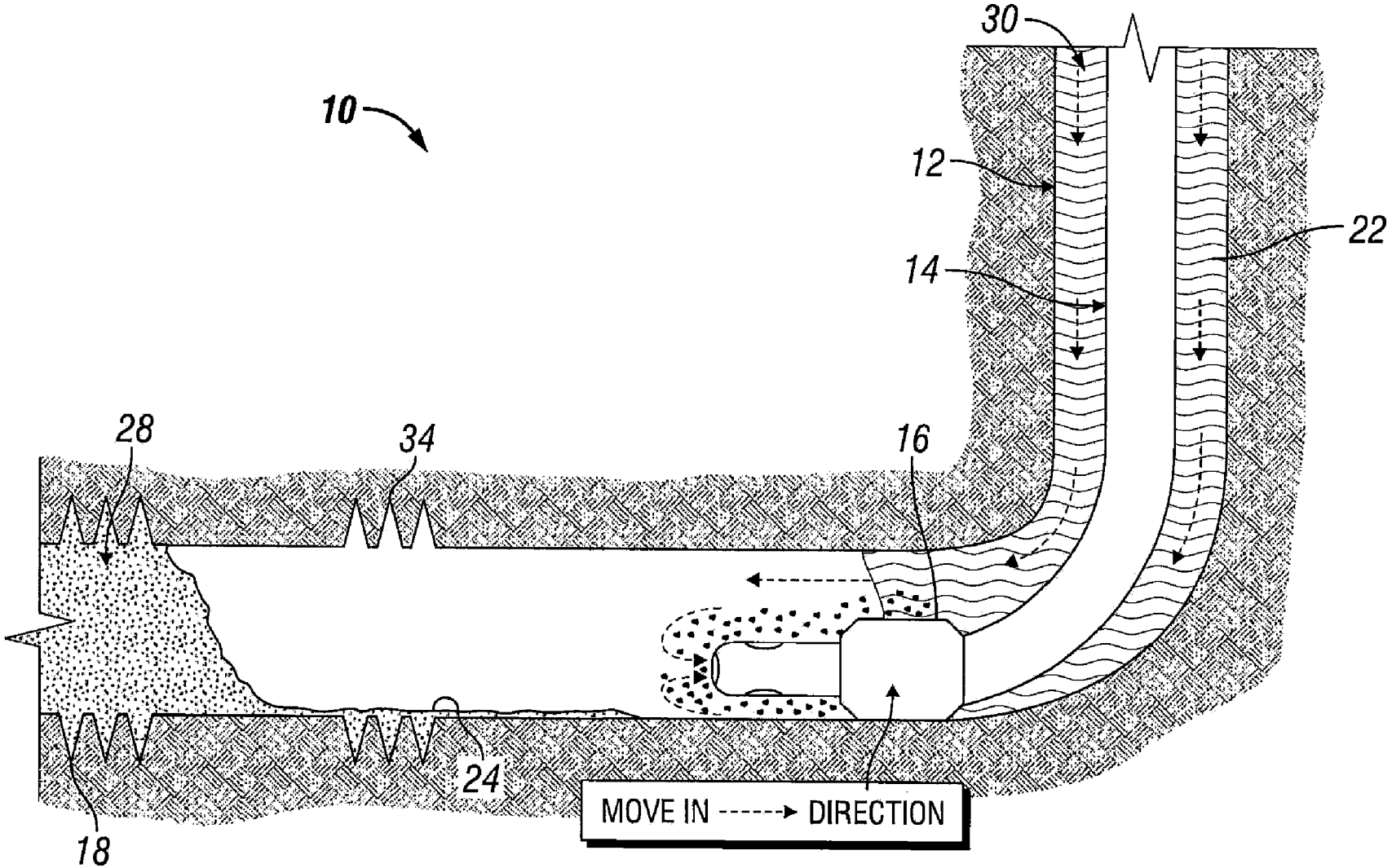
FIGS. 3B & 3C illustrates step 3 according to an alternative exemplary method of the present invention.
Figure 3C:
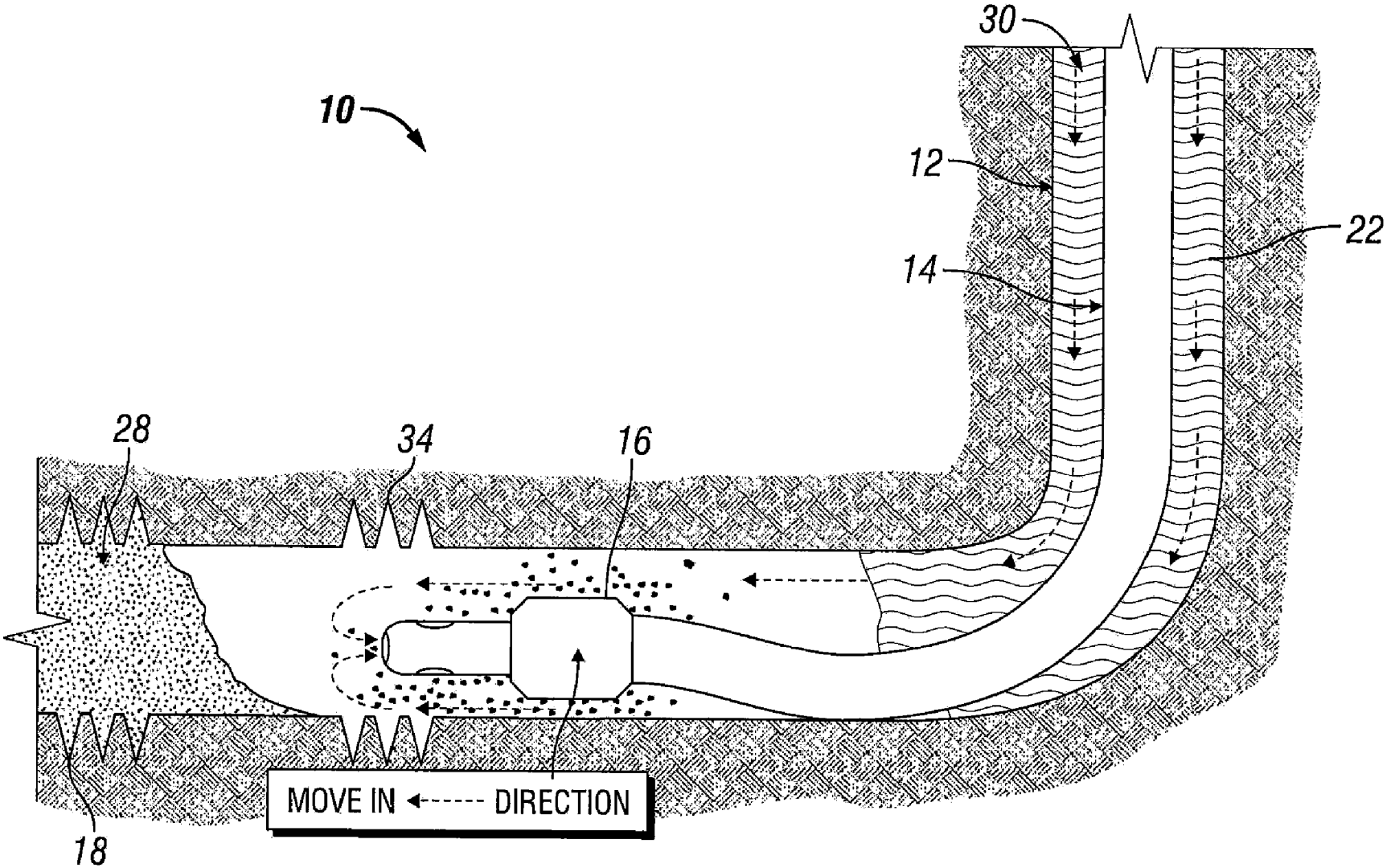

FIGS. 3B and 3C illustrate an alternative clean out process according to an exemplary embodiment of the present invention. Unlike in FIG. 3A where the solids of proppant bed 24 were completely or substantially cleaned out during reversing while pulling out of the hole, FIG. 3B illustrates an alternative method whereby only a portion of proppant bed 24 is cleaned out while moving the BHA 16 uphole and reversing. As illustrated in FIG. 3B, BHA is pulled uphole while reversing and cleaning out a portion of proppant bed 24. Once BHA 16 has been pulled up to a desired point, BHA 16 is run back into the hole whereby the remainder of proppant bed 24 is cleanout while reversing, as illustrated in FIG. 3C. For example, 80% of proppant bed 24 may be removed as BHA 16 is pulled out of the hole, while the remaining 20% may be removed as it is run back downhole. Please note, however, those of ordinary skill in the art having the benefit of this disclosure realize a variety of cleaning percentages can be utilized as desired in both the uphole and downhole directions.

Figure 4:
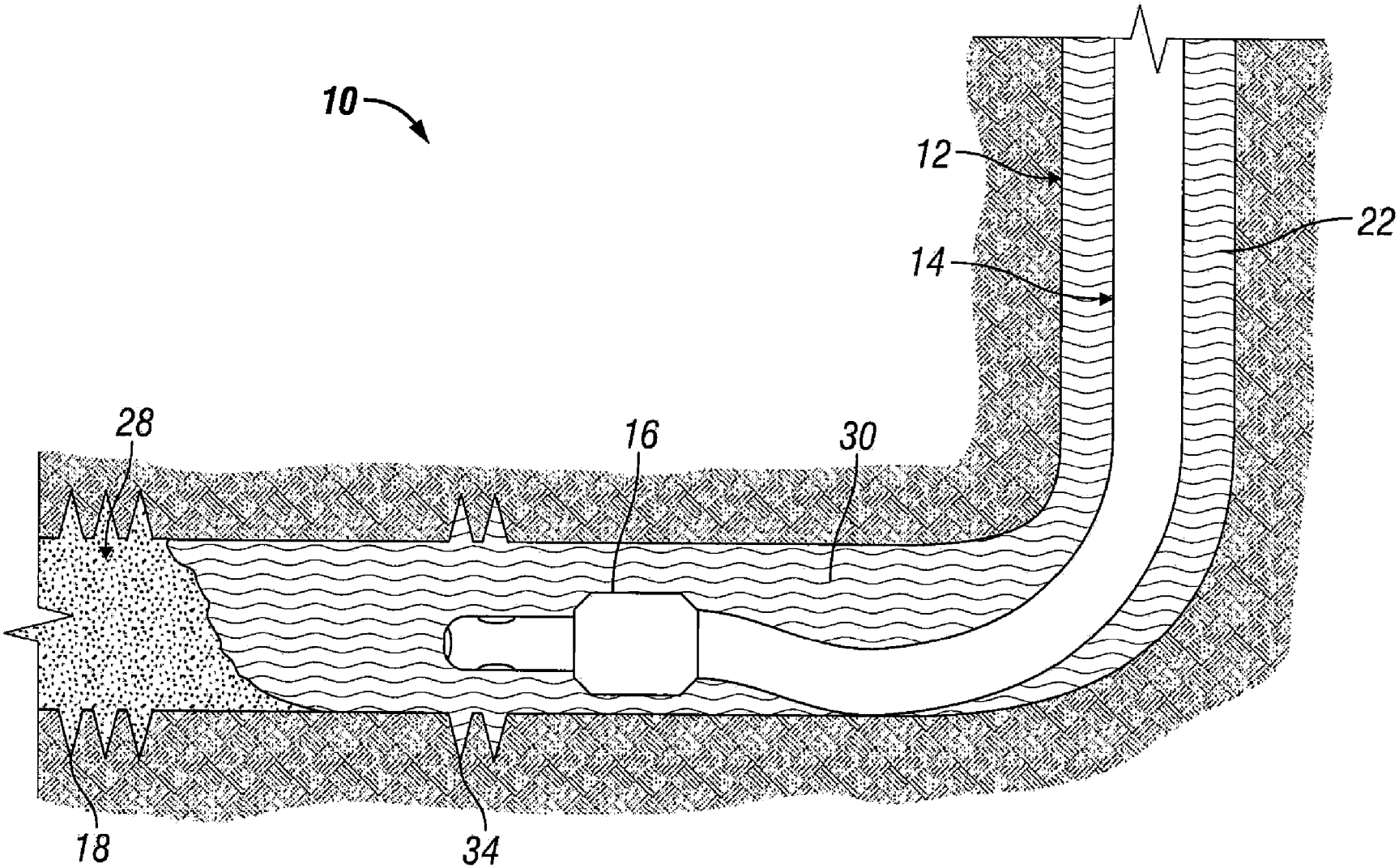
FIGS. 4 & 5 illustrate stage 4 according to an exemplary method of the present invention.
Figure 5:
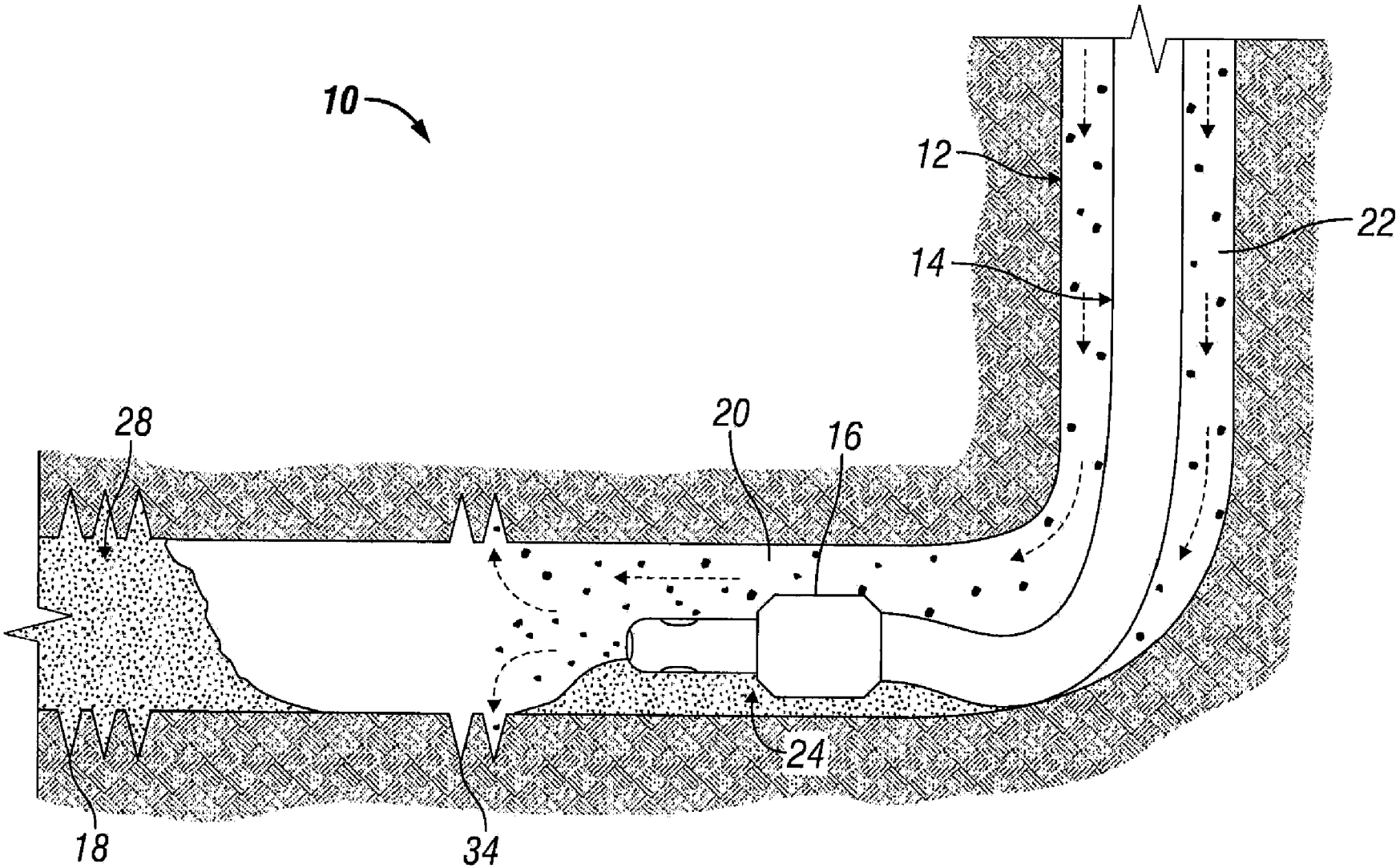

Referring to FIG. 4, step 4 in an exemplary method of the present invention will now be described. Now the residual solids and proppant bed 24 have been removed or at least substantially removed from casing 12 and cleanout fluid 30 is present downhole, sand plug 28 has been used to isolate perforations 18, and BHA 16 has been moved uphole during the cleanout process. Thereafter, as shown in FIG. 5, BHA 16 is moved uphole to the vicinity of the next interval 34 to be fractured (if desired) and fracturing of interval 34 may begin. As previously discussed, sand bed 24 is created during the fracturing and/or perforating of interval 34. Once perforated and fractured, interval 34 is isolated using, for example, another sand plug, and the clean out process begins all over again. Once casing 12 has been cleaned using the steps described herein, clean displacement fluid is again present in casing 12 and fracturing of further stages may begin again without the risk of premature screen out.

In an exemplary alternative embodiment, an intermediate step may be considered after perforating and before fracturing the first interval. For some formations, it may be desirable to perform an intermediate cleaning step where the small bed of residual abrasives on the low side of the hole are reverse circulated out of the hole, while pulling the BHA 16 uphole, before fracturing as described above. If the abrasive material is much smaller in size than the proppant, it can be left in the wellbore since, at the volume and concentrations present during fracture initiation, it should not cause a premature screen out. For the second and subsequent fracturing operations, any sand introduced into the wellbore during abrasive perforating will be removed at the same time that proppant from the previous fracture treatment is reverse circulated out, as previously discussed.

Figure 6:
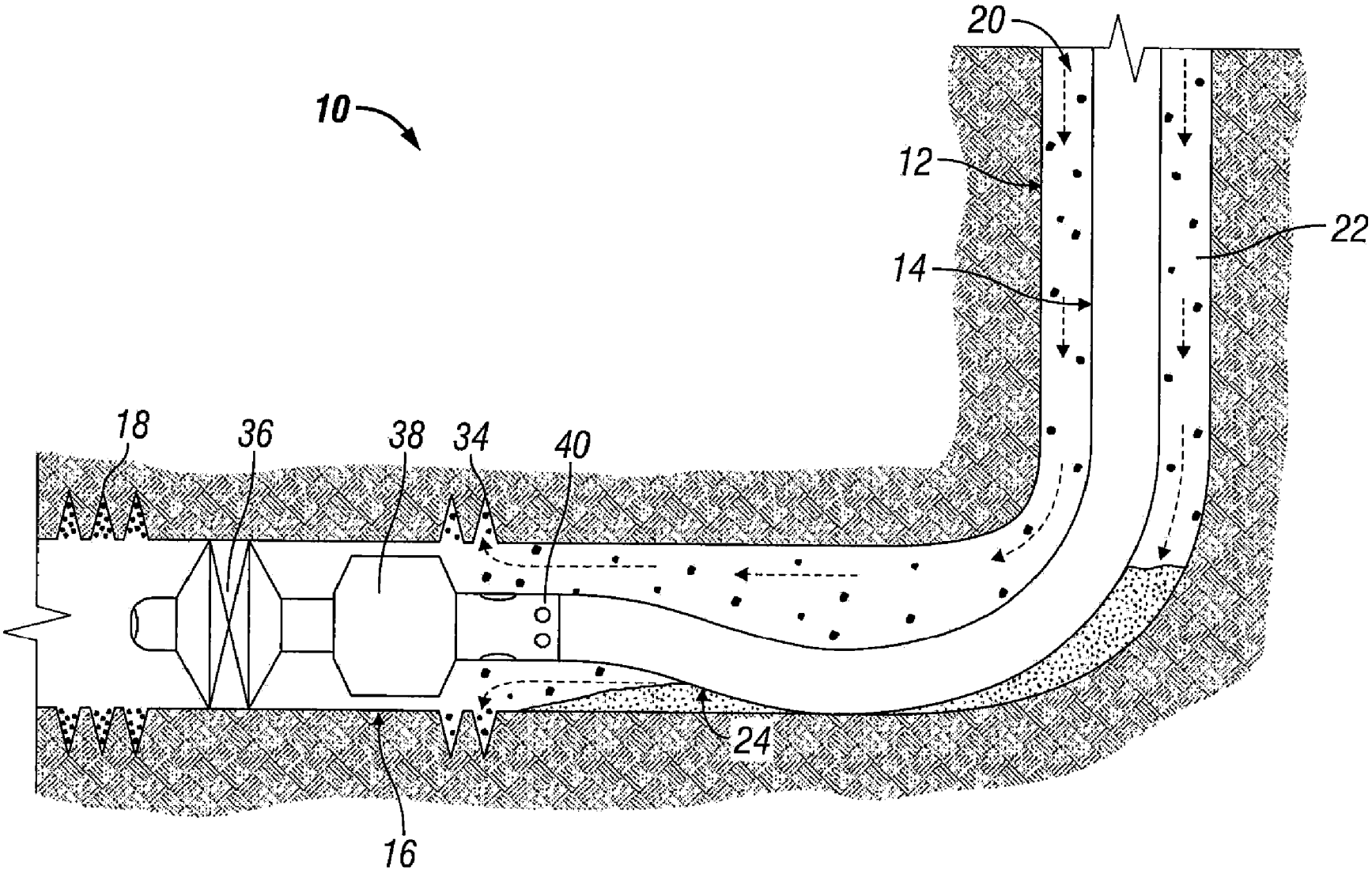
FIGS. 6 & 7 illustrate stage 4 according to an alternative exemplary method of the present invention.

FIG. 6 illustrates an alternative exemplary embodiment of the present invention whereby a mechanical isolation device 36, such as BJ's SureSet™ packer, is attached to the perforating assembly and utilized instead of sand plug 28. The SureSet packer is described in co-pending U.S. application Ser. No. 12/626,006, filed Nov. 25, 2009, entitled, "Coiled Tubing Bottom Hole Assembly With Packer and Anchor Assembly," owned by the assignee of the present invention, BJ Services Company of Houston, Tex., which is hererby incorporated by reference in its entirety. However, those ordinarily skilled in this art having the benefit of this disclosure realize there are a variety of mechanical isolation devices which may be utilized with the present invention.

As illustrated in the exemplary embodiment of FIG. 6, BHA 16 comprises a mechanical isolation device 36, a centralizer 38 (optional) and a perforating tool 40 having a reversing valve. In this embodiment, interval 18 is fractured and cleaned as previously discussed, however the use of additional proppant in the tail of the final stage of interval 18's frac is omitted (i.e., no sand plug is used to isolate interval 18). After interval 18 is cleaned, BHA 16 is positioned at the location of the next set of perforations 34. Thereafter, mechanical isolation device 36 is actuated and interval 34 is created using perforating tool 40. Thereafter, fracturing fluid 20 is pumped downhole to fracturing interval 34. Once again, as previously discussed, sand/proppant bed 24 is present and must be removed.

Referring to the exemplary embodiment of FIG. 6, an intermediate step may be considered after perforating and before fracturing. For some formations, it may be desirable to perform an intermediate cleaning step where the small bed of residual abrasives on the low side of the hole are reverse circulated out of the hole, with the BHA 16 stationary and device 36 actuated, before fracturing as described above. This would be required if the abrasive material volume and concentrations present would cause a premature screen out during fracture initiation.

Figure 7:
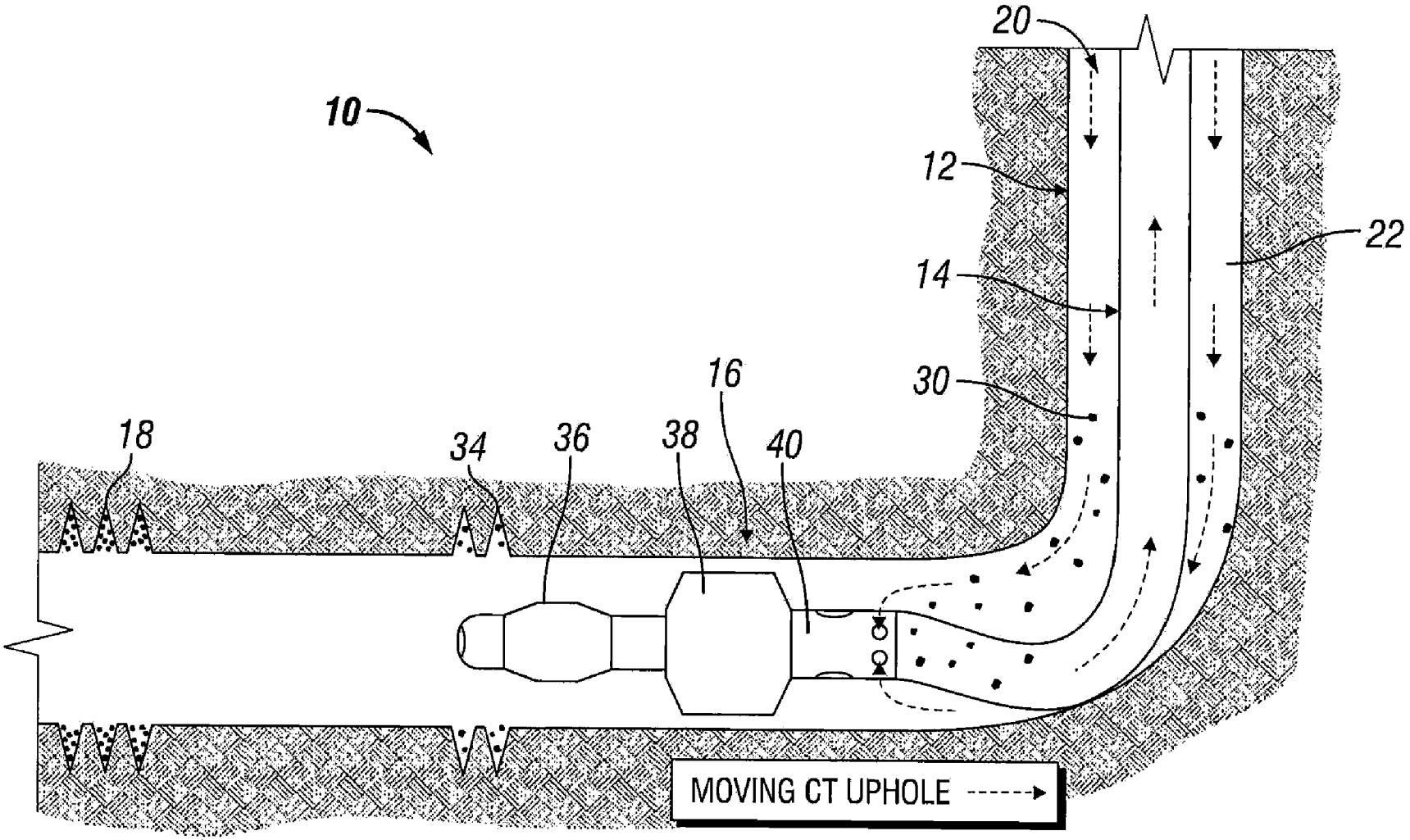

Referring to the exemplary embodiment of FIG. 7, after interval 34 has been fractured, mechanical isolation device 36 is unset from the casing and BHA 16 is moved uphole. Thereafter cleanout fluid 30 is pumped down the annulus 22 and up coiled tubing 14 via perforating tool 40, while BHA 16 is moved uphole a selected rate and distance, as previously described. Once the reversing process is complete, BHA 16 is positioned at the site of the next interval to be perforated, and then activated so that further perforations may be created. The newly perforated interval can then be fractured as previously described, with the energized packer isolating the perforations 34 of the previously fractured zone.

Referring to the exemplary embodiment of FIG. 6 some wells risk breaking down during the cleanup after interval 34 has been fractured. In such cases the mechanical isolation device 36 is unset, moved above the fractured interval, and then actuated again prior to the cleanout. Thereafter cleanout fluid 30 is pumped down the annulus 22 and up coiled tubing 14 via perforating tool 40, while BHA 16 remains stationary. Once the reversing process is complete, BHA 16 is positioned at the site of the next interval to be perforated, and then activated so that further perforations may be created. The newly perforated interval can then be fractured as previously described, with the energized packer isolating the perforations 34 of the previously fractured zone.

Although described as steps in the exemplary method detailed above, the cleanout process may also be utilized as a stand alone method. For example, in an exemplary stand alone method referencing FIG. 3A, BHA 16 may be moved upward a selected rate and distance, while moving solids and proppant bed 24 downhole using fluids circulated down annulus 22 as illustrated. In the most preferred embodiment, the selected distance in which BHA 16 is moved upward, is a distance whereby the BHA 16 remains in the horizontal section of the wellbore 10 as previously discussed. Such an exemplary method may not include proppant plug 28, but may include some other isolation device or none at all. Moreover, the cleanout process may be used to cleanout perforation solids after a perforation, fracturing solids after fracturing or some other downhole solids. Also, in the alternative, the exemplary clean out method described in FIGS. 3B and 3C may also be used as a stand alone method. Those ordinarily skilled in the art having the benefit of this disclosure will realize that this clean up method may be used in a variety of processes.

The annular reverse circulating rates and the pull out of holes speeds utilized with the present invention are computed to minimize the total time spent pumping and positioning the BHA at the next interval to be perforated. Those ordinarily skilled in the art having the benefit of this disclosure realize there are a variety of ways in which to determine these variables. In an exemplary embodiment, such methods of computation are based upon solid transport flow loops, such as those disclosed in U.S. Pat. No. 7,377,283, entitled "COILED TUBING WELLBORE CLEANOUT," issued on May 27, 2008, owned by the Assignee of the present invention, BJ Services Company of Houston, Tex., which is hereby incorporated by reference in its entirety.

Figure 8:
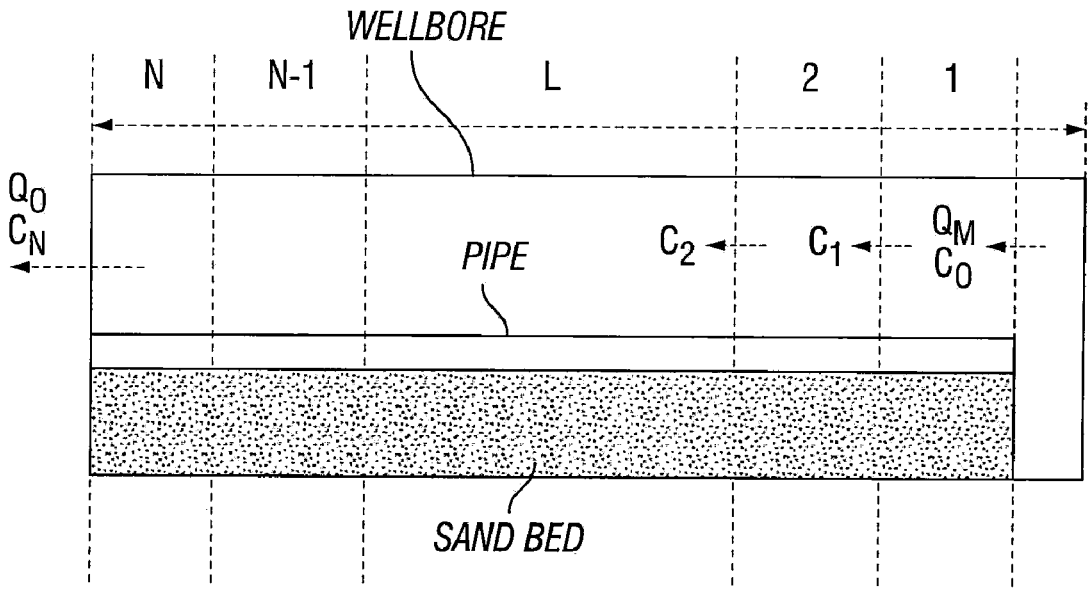
FIG. 8 illustrates an exemplary graph illustrating a Mass Balance for Stationary Hole Cleaning Prediction.

During testing of the present invention, run in hole ("RIH") speeds and pull out of hole ("POOH") speeds were determined for a given flow rate using these flow loops. The recorded parameters also included, for example, flow rate and fluid density and temperature, as well as RIH and POOH speeds. This data was collected from instrumentation which recorded the values using a computer controlled data acquisition system. Once the data had been collected, it was used to predict cleaning times while using the conventional stationary hole cleaning method as previously discussed herein. As such, for a horizontal well section having a length L, N sections were divided along the well as shown in FIG. 8, which illustrates the Mass Balance for Stationary Hole Cleaning Prediction. In each subsection, the solids mass balance equation can be expressed as:

$$\frac{dQ_1}{dt} = Q_m(C_o - C_1) \quad 1$$

$$\frac{dQ_2}{dt} = Q_m(C_1 - C_2) \quad 2$$

$$\ldots$$

$$\frac{dQ_N}{dt} = Q_m(C_{N-1} - C_N) \quad 3$$

Experimental observations by several researchers suggests that the sand concentration during the solids bed erosion processes can be represented by a simple logarithmic expression if the circulation fluid rate was high enough to clean the hole completely:

$$C_i = C^o e^{-\beta_i t},\ i = 1 \text{ to } N \quad 4$$

Summation of equations 1 to 3 and let $Q_s = Q_1 + Q_2 + \ldots + Q_N$ results in $$\frac{dQ_s}{dt} = Q_m(C_o - C_N) \quad 5$$

Substituting equation 4 into 5 results in $$\frac{dQ_s}{dt} = Q_m(C_o - C^o e^{-\beta_N t}) \quad 6$$

When the stationary circulation mode is used to clean the hole, $C_0 = 0$, therefore, with boundary condition; $t \rightarrow \propto$, $e^{-\beta_N t} \rightarrow 0$ and $Q_s \rightarrow 0$, the equation 6 can be integrated as:

$$\frac{Q_s}{Q_s^o} = \exp\left(-\frac{Q_m}{Q_s^o}C^o t\right) \quad 7$$

Based on the equation 7 , the hole cleaning time can be predicted as:

$$t = \frac{Q_s^o}{C^o Q_m}\ln\left(\frac{Q_s^o}{Q_s}\right) \quad 8$$

Where:

$C^o$=initial sand concentration, in decimal $C_o$ to $C_N$=sand volume concentration at each interface between the subsections, sand true volume/circulated liquid volume, in decimal $dQ_1/dt$ to $dQ_N/dt$=sand volume change rate in subsection 1 to N, respectively; $m^3$/min L=the length of the horizontal wellbore section, m $Q_1$ to $Q_N$=sand true volume remained in subsection 1 to N, respectively; $m^3$.

$Q_m$=circulated liquid flow rate, $m^3$/min $Q_s$=total sand volume remained in the wellbore annulus, $m^3$ $Q_s^o$=initial sand volume remained in the wellbore annulus, $m^3$ t=hole cleaning time, minute to=the required hole cleaning time to clean 99% of the initial solids volume, minute $\beta_N$=the time constant defined in equation 4

Equation 8 is a simple model which shows how each individual parameter affects the hole cleaning time. The usefulness of this model depends on whether the time constant, $\beta_N$, is easy to predict based on a mechanistic analysis of the process. Alternatively, the dependencies of the time constant may be assessed from experimental data, or the solids concentrations, $C_1$ to $C_N$, can be directly predicted based on the correlation developed in experimental study.

Figure 11:
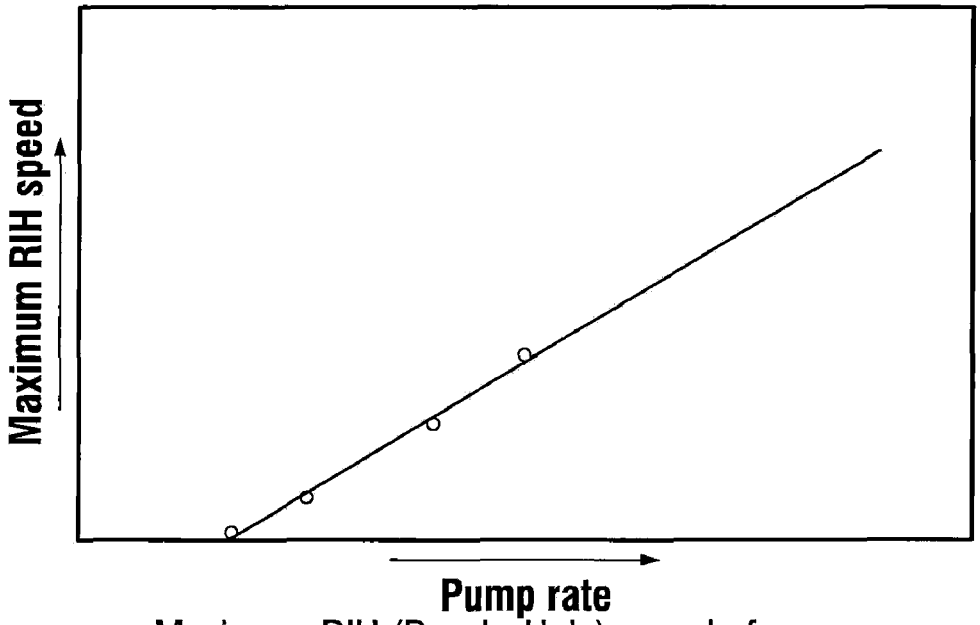
FIGS. 11-13 illustrate exemplary graphs plotting correlations used to predict the maximum RIH, POOH and hole cleaning efficiency using the cleaning method of the present invention.

Due to the non-linear relationship between the carrying capacity and the in-situ liquid velocity, it is expected that the hole cleaning time will also change non-linearly with the circulation fluid flow rate as shown in FIG. 11 (which will be discussed later). Equation 8 indicates that increasing the liquid circulation rate results in a lower hole cleaning time.

Figure 9:
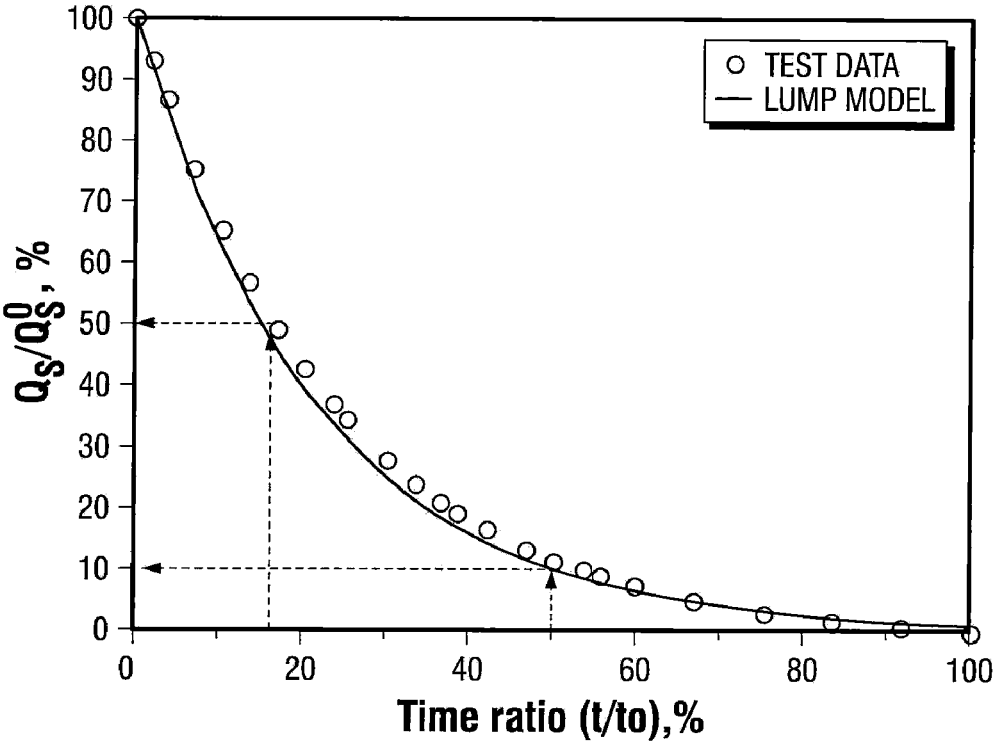
FIG. 9 illustrates an exemplary graph plotting the circulation time ratio vs. the removed solids volume ratio based upon a lump model for stationary hole cleaning in a horizontal wellbore.

FIG. 9 illustrates why it takes so long to clean the horizontal well using conventional stationary cleaning techniques. Being derived from Equation 8 , FIG. 9 plots the hole cleaning time ratio versus the cleaned out solids volume ratio. As can be seen, the lump model fits very well with the flow loop test results. Here, it is assumed the time required to clean 99% of the initial solids volume ($Q_s/Q_s^o$=0.01) is the base time (100%). FIG. 9 also shows that it only takes about 16% of the base time to clean half of the initial solids volume. In other words, if it takes 100 minutes to clean 99% of the initial solids volume, it only takes 16 minutes to clean 50% of the initial solids volume. For field applications, this means that the most efficient hole cleaning period is the first few minutes.

After cleaning the hole for a while, pumping at a higher liquid rate, instead of a constant rate, would result in a more efficient hole cleaning method because the sand bed height is reduced after a certain cleaning period and, as a result, the in-situ liquid velocity decreases: therefore, the shear force acting at the bed interface is reduced. In order to generate a high enough shear force at the interface to efficiently erode the solids bed, a higher flow rate is required. FIG. 9 also indicates that the last 10% of the remaining solids would take 50% of total cleaning time, since the local velocity is so low in that wedged region near bottom of the annulus between the coiled tubing and the wellbore/casing: the very reason why it takes so long time to clean the horizontal well using the stationary cleaning mode.

Figure 10:
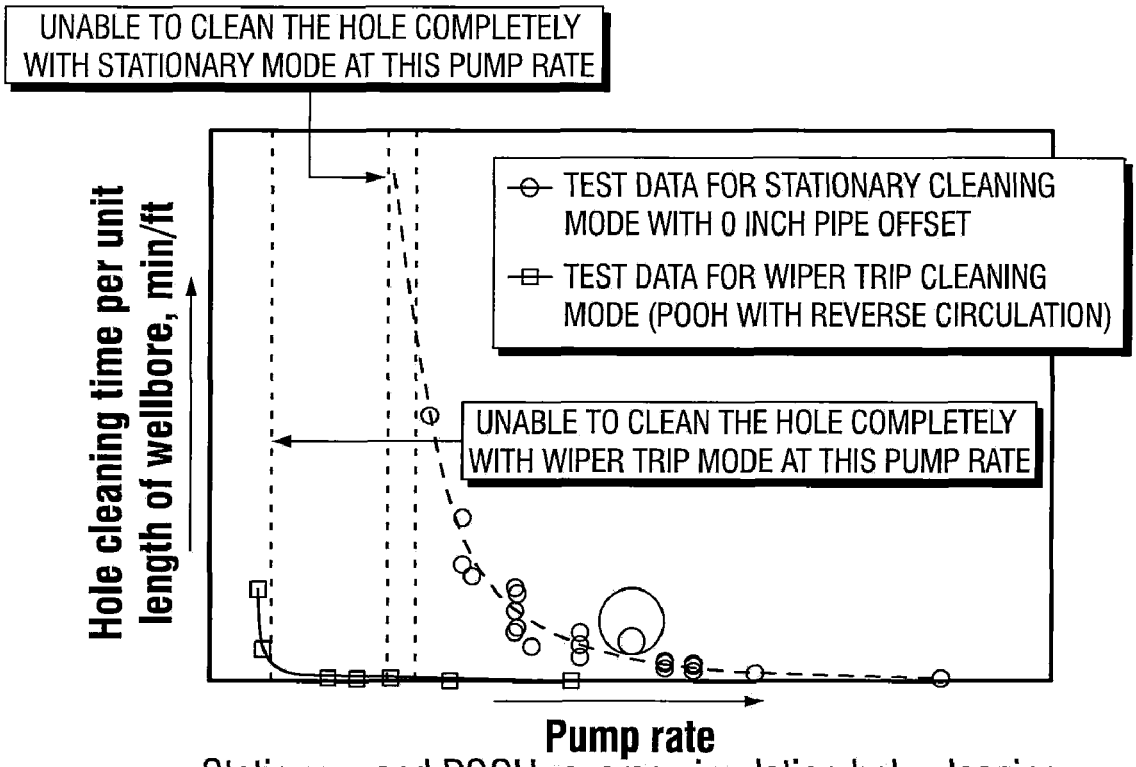
FIG. 10 illustrates an exemplary graph plotting a correlation between the pump rate and hole cleaning times with stationary circulation or POOH while reverse circulating in a horizontal wellbore.

As a result of the data depicted in FIGS. 8 and 9 (i.e., flow loop data), correlations were developed during testing to assist operators in creating job designs. These "correlations" were developed by incorporating the flow loop data into a solids transport computer software product such as, for example, the Circa™ software program, developed by BJ Services Company of Houston, Tex. FIG. 10 illustrates an exemplary correlation plotting a comparison of the hole cleaning time with both the conventional stationary mode and cleaning mode of the present invention (i.e., reversing while POOH). Here, the graph reveals the cleaning times are non-linearly correlated with the fluid pump rate in a horizontal wellbore. Moreover, it also indicates that the cleaning method of the present invention is much more efficient that the stationary mode. With stationary circulation, solids have to be eroded from the stationary bed and rolled forward by the fluid, resulting in a less efficient cleaning process.

Figure 12:
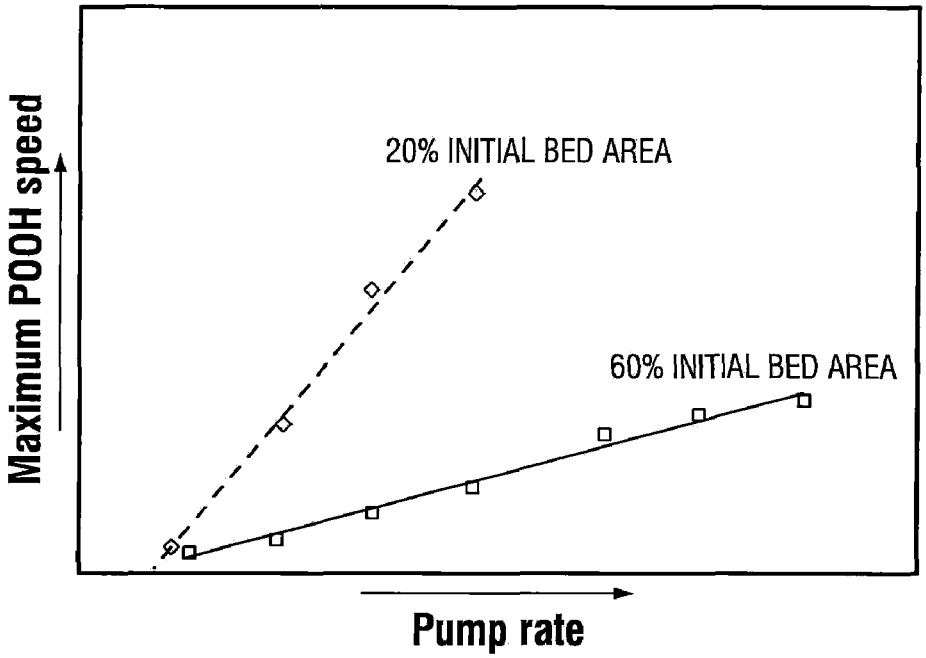

The maximum POOH speed is defined as that the fastest POOH speed at or below a speed in which all the solids could be completely removed. If the POOH speed is above the maximum POOH speed, there is always some solids left behind the hole. The maximum RIH speed is defined as the maximum coiled tubing penetration rate at which the end of a coil does not insert itself into the sand column for a given flow rate, and all the solids would be completely cleaned out. The maximum POOH and RIH speeds can be determined with the flow loops previously discussed. As a result, both maximum POOH and RIH speeds can be correlated with the pump rate as shown in FIGS. 11 and 12, respectively.

FIG. 11 illustrates an exemplary plot of the maximum RIH speed of reverse circulation with water in a horizontal wellbore. The plot indicates that the maximum RIH speed is affected by the pump rate, and a higher pump rate results in a higher RIH speed. FIG. 12 illustrates an exemplary plot of the maximum POOH speed of reverse circulation with water in a horizontal wellbore. The plot indicates that the maximum POOH speed is affected by the initial solids bed condition. As shown, a higher initial bed height would result in a lower POOH speed for a given pump rate. For a given initial sand bed condition, a higher pump rate results in a higher POOH speed. Accordingly, with the correlations in FIGS. 11 and 12, the RIH or POOH time across a given length of horizontal section can be determined for a given pump rate.

Figure 13:
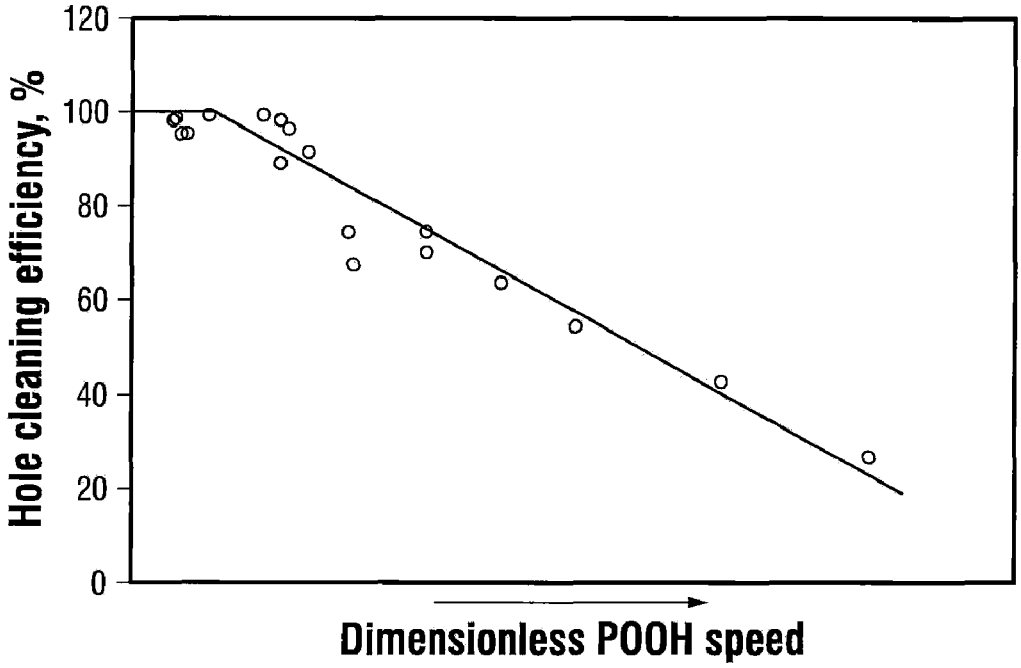

FIG. 13 illustrates an exemplary graph of the hole cleaning efficiency of the cleaning method of the present invention. If the POOH speed is less than or equal to the maximum POOH speed, the hole cleaning efficiency is 100%, which means that everything is cleaned out of the hole. If the POOH speed is above the maximum POOH speed, however, there are some sands left behind the hole.

Figure 14:
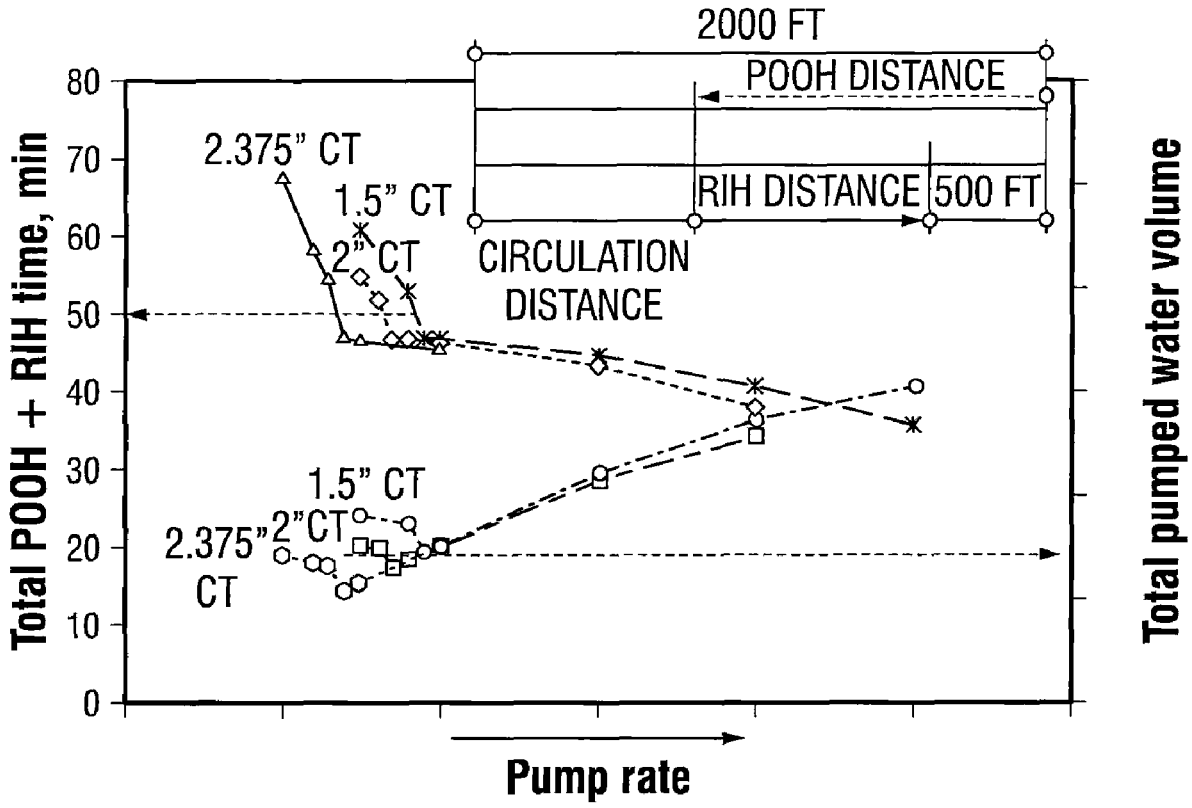
FIG. 14 illustrates an exemplary graph used to optimize the hole cleaning methods of the present invention.

The correlations developed in FIGS. 10-13 can be incorporated into the Circa™ software previously discussed, for example, and used by those ordinarily skilled in the art having the benefit of this disclosure to optimize the hole cleaning process during both POOH and RIH stages of exemplary methods of the present invention. FIG. 14 displays an exemplary plot of the total POOH/RIH time and the total pumped water volume used at different pump rates when water is reversed circulated while pulling the coiled tubing out of the hole and when running back into the hole along 4.5" casing with 1.5", 2" and 2.375" coiled tubing. Only after running back in the hole would the solids be 100% cleaned out. The total cleaned horizontal section is 2000 feet. The circulation distance refers to the hole cleaning section which is swept by the circulation flow alone. The POOH distance refers to the hole cleaning section which is partially swept while pulling out of the hole and reversing. During RIH, the well is completely cleaned while reverse circulating. The RIH distance is 500 ft shorter than the POOH distance, as that is the assumed location of a subsequent frac.

FIG. 14 illustrates an exemplary plot of the total POOH/RIH time and the total pumped water volume at different pump rates when water is reverse circulated while pulling out of the hole and subsequently running the coiled tubing back into the hole along 4.5" casing with 1.5", 2" and 2.375" coiled tubing. During POOH, there is partial solids cleanout. To prevent the coiled tubing from becoming stuck in the hole, especially when solid beds have formed, it is preferable to reverse circulate the fluid to clean the fills while pulling out of the hole. In this case, the solids would be 100% cleaned out only after the coiled tubing is run back into the hole. There is a minimum total pumped volume point, for each coiled tubing size corresponding to its optimum operation condition.

An exemplary embodiment of the present invention includes a method for cleaning out a horizontal wellbore using coiled tubing, the method comprising the steps of inserting coiled tubing into the horizontal wellbore, the coiled tubing comprising a BHA; and circulating fluid down an annulus of the horizontal wellbore and back up the coiled tubing while moving the BHA uphole at a selected rate and distance. This exemplary method may further comprise at least perforating an interval of the horizontal wellbore before circulating fluid down the annulus. In the alternative, the exemplary method may include fracturing an interval of the horizontal wellbore. This exemplary method may further comprise at least substantially removing solids from the horizontal wellbore. The step of circulating in this method may be conducted without removing the BHA from the horizontal section of the horizontal wellbore or from the horizontal wellbore itself. Lastly, in the alternative, the step of circulating in this method may be utilized to remove a portion of solids from the horizontal wellbore, the method further comprising the step of running the BHA back into the horizontal wellbore and removing a remainder of the solids from the horizontal wellbore using fluid circulation.

An alternative exemplary embodiment of the present invention includes a method for cleaning out a horizontal wellbore using coiled tubing, the method comprising the steps of deploying coiled tubing into the horizontal wellbore, the coiled tubing comprising a BHA; at least perforating a first interval of the horizontal wellbore; circulating fluid down an annulus of the horizontal wellbore and back up the coiled tubing while moving the BHA uphole at a selected rate and distance; and at least perforating a second interval of the horizontal wellbore. This exemplary method may further comprise conducting the perforating and circulation steps without removing the BHA from the horizontal section of the wellbore. This exemplary method may further comprise removing solids from the horizontal wellbore. Lastly, in the alternative, the step of circulating in this method may be utilized to remove a portion of solids from the horizontal wellbore, the step of circulating further comprising the step of running the BHA back into the horizontal wellbore and removing a remainder of the solids from the horizontal wellbore using fluid circulation.

An alternative exemplary embodiment of the present invention includes a method for cleaning out a horizontal wellbore using coiled tubing, the method comprising the steps of at least perforating a first interval of the horizontal wellbore; and circulating solids in the horizontal wellbore up the coiled tubing while moving the coiled tubing uphole. In this exemplary method, the coiled tubing may comprise a BHA which remains in the horizontal wellbore or, in the alternative, below a build section of the horizontal wellbore during circulation. The step of circulating the proppant bed up the coiled tubing may be achieved by circulating fluid down the annulus of the horizontal wellbore and back up a BHA forming part of the coiled tubing, the annulus being located between the coiled tubing and casing. This exemplary method may further comprise the step of at least perforating a second interval of the horizontal wellbore without removing the coiled tubing from the horizontal wellbore. Lastly, in the alternative, the step of circulating in this method may only remove a portion of the solids from the horizontal wellbore, the method further comprising the step of running the coiled tubing back into the horizontal wellbore and removing a remainder of the solids from the horizontal wellbore using fluid circulation.

An alternative exemplary embodiment of the present invention includes a method for cleaning out a horizontal wellbore using coiled tubing, the method comprising the steps of deploying coiled tubing into the horizontal wellbore, the coiled tubing including a BHA; perforating and fracturing a first interval of the horizontal wellbore; circulating fluid down an annulus of the horizontal wellbore and back up the coiled tubing while moving the BHA uphole; and perforating and fracturing a second interval of the horizontal wellbore. This exemplary method may further comprise the step of at least substantially removing a proppant bed from a horizontal section of the horizontal wellbore. This exemplary method may further comprises the step of circulating fluid down the annulus of the horizontal wellbore and back up the coiled tubing after perforating is complete and before fracturing begins, thereby at least substantially removing residual abrasives from the horizontal wellbore. The perforating and circulating steps may be conducted without removing the BHA from the horizontal wellbore or, in the alternative, a horizontal section of the horizontal wellbore. Lastly, in the alternative, the step of circulating in this method may only remove a portion of solids from the horizontal wellbore, the step of circulating further comprising the step of running the BHA back into the horizontal wellbore and removing a remainder of the solids from the horizontal wellbore using fluid circulation.

The present invention has a number of advantages over the prior art. First, the present method cuts current clean up time by roughly 50% because the BHA is moving upwards while the proppant bed is moving downwards. As such, the proppant bed is forced up coil tubing at twice the rate of a conventional reversing processing, also resulting in approximately 60% more fracturing stages being pumped per day. Second, the present invention allows for fracturing of multiple intervals without pulling the BHA out of the well. Each of these advantages results in a more efficient and profitable well treatment.

Although various embodiments have been shown and described, the invention is not so limited and will be understood to include all such modifications and variations as would be apparent to one skilled in the art. For example, the cleanout process, whereby the BHA is moved upward while fluid is circulated down the annulus, may be used to cleanout wellbores at a variety of points during downhole operations. Also, dependent upon the conditions downhole, isolation techniques may or may not be necessary to implement the cleanout process. As such, those ordinarily skilled in the art having the benefit of this disclosure realize the cleanout process described herein may be employed in a number of ways. Accordingly, the invention is not to be restricted except in light of the attached claims and their equivalents.

What is claimed is:

1. A method for cleaning out a horizontal wellbore using coiled tubing, the method comprising the steps of:

(a) inserting coiled tubing into the horizontal wellbore, the coiled tubing including a bottom hole assembly; and (b) circulating fluid down an annulus of the horizontal wellbore and back up the coiled tubing while moving the bottom hole assembly and coiled tubing uphole at a selected rate and distance.

2. A method as defined in claim 1, wherein step (a) further comprises at least perforating an interval of the horizontal wellbore.

3. A method as defined in claim 1, wherein step (a) further comprises fracturing an interval of the horizontal wellbore.

4. A method as defined in claim 1, wherein step (b) further comprises at least substantially removing solids from the horizontal wellbore.

5. A method as defined in claim 1, wherein step (b) is conducted without removing the bottom hole assembly from a horizontal section of the horizontal wellbore.

6. A method as defined in claim 1, wherein step (b) is conducted without removing the bottom hole assembly from the horizontal wellbore.

7. A method as defined in claim 1, wherein step (b) is utilized to remove a portion of solids from the horizontal wellbore, the method further comprising the step of running the bottom hole assembly back into the horizontal wellbore and removing a remainder of the solids from the horizontal wellbore using fluid circulation.

8. A method for cleaning out a horizontal wellbore using coiled tubing, the method comprising the steps of:

(a) deploying coiled tubing into the horizontal wellbore, the coiled tubing including a bottom hole assembly;

(b) at least perforating a first interval of the horizontal wellbore;

(c) circulating fluid down an annulus of the horizontal wellbore and back up the coiled tubing while moving the bottom hole assembly and coiled tubing uphole at a selected rate and distance; and (d) at least perforating a second interval of the horizontal wellbore.

9. A method as defined in claim 8, wherein steps (b)-(d) are conducted without removing the bottom hole assembly from a horizontal section of the horizontal wellbore.

10. A method as defined in claim 8, wherein steps (b)-(d) are conducted without removing the bottom hole assembly from the horizontal wellbore.

11. A method as defined in claim 8, wherein step (c) further comprises removing solids from the horizontal wellbore.

12. A method as defined in claim 8, wherein step (c) is utilized to remove a portion of solids from the horizontal wellbore, step (c) further comprising the step of running the bottom hole assembly back into the horizontal wellbore and removing a remainder of the solids from the horizontal wellbore using fluid circulation.

13. A method for cleaning out a horizontal wellbore using a coiled tubing, the method comprising the steps of:

(a) at least perforating a first interval of the horizontal wellbore; and (b) circulating solids in the horizontal wellbore up the coiled tubing while moving the coiled tubing uphole.

14. A method as defined in claim 13, where in step (b) a bottom hole assembly remains below a build section of the horizontal wellbore, the coiled tubing including the bottom hole assembly.

15. A method as defined in claim 13, where in step (b) a bottom hole assembly remains in the horizontal wellbore, the bottom hole assembly being attached to the coiled tubing.

16. A method as defined in claim 13, wherein the step of circulating the solids up the coiled tubing is achieved by circulating fluid down an annulus of the horizontal wellbore and back up a bottom hole assembly forming part of the coiled tubing, the annulus being located between the coiled tubing and casing.

17. A method as defined in claim 13, the method further comprising the step of at least perforating a second interval of the horizontal wellbore without removing the coiled tubing from the horizontal wellbore.

18. A method as defined in claim 13, wherein step (b) only removes a portion of the solids from the horizontal wellbore, the method further comprising the step of running the coiled tubing back into the horizontal wellbore and removing a remainder of the solids from the horizontal wellbore using fluid circulation.

19. A method for cleaning out a horizontal wellbore using coiled tubing, the method comprising the steps of:

(a) deploying coiled tubing into the horizontal wellbore, the coiled tubing including a bottom hole assembly;

(b) perforating and fracturing a first interval of the horizontal wellbore;

(c) circulating fluid down an annulus of the horizontal wellbore and back up the coiled tubing while moving the bottom hole assembly and coiled tubing uphole; and (d) perforating and fracturing a second interval of the horizontal wellbore.

20. A method as defined in claim 19, wherein step (c) further comprises the step of at least substantially removing a proppant bed from a horizontal section of the horizontal wellbore.

21. A method as defined in claim 19, wherein step (b) further comprises the step of circulating fluid down the annulus of the horizontal wellbore and back up the coiled tubing after perforating is complete and before fracturing begins, thereby at least substantially removing residual abrasives from the horizontal wellbore.

22. A method as defined in claim 19, whereby steps (b)-(d) are conducted without removing the bottom hole assembly from a horizontal section of the horizontal wellbore.

23. A method as defined in claim 19, whereby steps (b)-(d) are conducted without removing the bottom hole assembly from the horizontal wellbore.

24. A method as defined in claim 19, wherein step (c) only removes a portion of solids from the horizontal wellbore, step (c) further comprising the step of running the bottom hole assembly back into the horizontal wellbore and removing a remainder of the solids from the horizontal wellbore using fluid circulation.

25. A method for cleaning out a horizontal wellbore using coiled tubing, the method comprising the steps of:

(a) inserting coiled tubing into the horizontal wellbore, the coiled tubing having a lower end;

(b) after step (a), and while the lower end of the coiled tubing remains in the horizontal wellbore, introducing solids into an annulus of the horizontal wellbore;

(c) forming a bed of solids in the horizontal wellbore;

(d) circulating fluid down the annulus of the horizontal wellbore and back up the coiled tubing while moving the coiled tubing uphole at a selected rate and distance; and (e) utilizing the circulated fluid to remove at least a portion of the bed of solids while moving uphole.

26. A method as defined in claim 25, wherein step (c) further comprises the step of forming the bed of solids behind the lower end of the coiled tubing, the bed of solids extending upward toward a build section of the horizontal wellbore.

27. A method as defined in claim 25, wherein step (b) further comprises the step of causing the lower end of the coiled tubing to remain in a horizontal section of the horizontal wellbore while introducing the solids.

28. A method as defined in claim 25, the method further comprising the steps of:

running the end of the coiled tubing back into the horizontal wellbore; and removing a remainder of the bed of solids from the horizontal wellbore using fluid circulation.

* * * * *